United States Patent [19]

Favale

[11] 4,430,843

[45] Feb. 14, 1984

[54] MAILING AND DISPLAY PACKAGE

[76] Inventor: Dennis Favale, 1920 N. Ruby St., Melrose Park, Ill. 60160

[21] Appl. No.: 294,460

[22] Filed: Aug. 20, 1981

[51] Int. Cl.[3] ..... B65B 61/00; B65D 75/38; B65D 65/18

[52] U.S. Cl. ..... 53/410; 206/463; 206/471; 53/455; 53/459; 229/92.8

[58] Field of Search ..... 206/463, 462, 461, 471; 229/92.8; 53/467, 468, 452, 482, 410, 427, 455

[56] References Cited

U.S. PATENT DOCUMENTS

| | | | |
|---|---|---|---|
| 2,491,423 | 12/1949 | Snyder | 206/463 |
| 3,064,402 | 11/1962 | Crane, Jr. | 206/463 |
| 3,298,515 | 1/1967 | Watts, Jr. | 206/462 |
| 3,307,281 | 3/1967 | Mateo | 229/92.8 |
| 3,695,417 | 10/1972 | Stoker, Jr. | 206/462 |

*Primary Examiner*—William T. Dixson, Jr.
*Attorney, Agent, or Firm*—Basil E. Demeur; Robert E. Knechtel

[57] ABSTRACT

A mailing and display package and method for manufacturing the same is prepared from a cardboard or paper board blank which is divided into two panels by a fold line. A window is cut in the blank and is symmetrical in each of the two panels on each side of the fold line and is further bordered on all sides by the blank. A piece of transparent film covers the window and the blank is folded along the fold line until the two panels of the blank are in face to face contact at which time they are secured to each other. The transparent film material forms an enclosed transparent pouch to retain a product for mailing or displaying.

3 Claims, 7 Drawing Figures

MAILING AND DISPLAY PACKAGE

BACKGROUND AND SUMMARY OF THE INVENTION

The present invention relates in general to packaging and more particularly to a pakcage which can be used for both mailing and display purposes, and the method of manufacturing the same.

There are various types of display and mailing packages known in the art. One type is the blister package which is made of a transparent rigid plastic such as a polyvinyl chloride or polyvinyl acetate. It is molded in a die to the desired shape by vacuum drawing or other customary techniques for molding plastic articles. The pre-formed blister package is filled and then assembled into the package. This is an extremely expensive process in that special dies are required for each type of article to be packaged. Another method of packaging is to wrap the article in a transparent pouch and then secure the pouch to a backer. This type of package does not have a neat, smooth appearance, and requires the steps of manufacturing the pouch and then mounting the pouch to the backer, which increases manufacturing time and the attendant cost thereof. Additionally, the pouch is often torn loose from the backing thereby permitting the packaged article to become removed from the package.

Another method of packaging is disclosed in U.S. Pat. No. 3,192,681 which utilizes a heat shrinkable film which encases the article for display purposes. The intent is to have a finished package which has the appearance of a pre-molded blister package, without the cost of making special dies. A shortcoming with this type of packaging is that the transparent pouch is only secured to the backing along one of its edges. This is necessary so that the pouch can shrink around the article to be displayed in the other three directions. This results in a pouch which is not completely sealed either to itself or to the backing enabling the contents to possible be released from the pouch or allow external moisture to enter the pouch.

Another form of mailer packages shown in U.S. Pat. No. 2,707,589, which describes a mailing container formed by a sheet of paper or cardboard folded into an envelope. The envelope includes a plurality of flaps arranged around the body of the sheet constitutes the central portion of the container. The articles held in position by means of a transparent retainer member is secure over a small window. One flap of the container is shown to form the backing for the article, while the transparent retainer member secured thereover. The inherent problem with this container is the fact that the entire article held in the package cannot be made visible to the consumer, since the window is quite small, and the greater portion of the article retained therein is secured against the paper or cardboard backing and therefore not visible to the consumer.

Another form of window-type package is ahown in U.S. Pat. No. 3,921,319. The package disclosed therein is intended to be secured to a larger package, the smaller packet or package having a window therein in which a letter or other written indicia is inserted. The typical use of a package of this type is exemplified in FIG. 3 of the drawings wherein a larger article to be forwarded by mail is enclosed within a large package, and written matter pertaining to the contents of the larger package are accommodated in the windowed package secured by adhesive or other similar means to the larger package. Once again, the package as depicted in U.S. Pat. No. 3,921,319 is not intended to permit any large articles to be accommodated therein, especially in a manner which would permit easy visual observation of the article packaged therein.

Another form of package is shown in U.S. Pat. No. 4,053,050, which is directed to a display package. As is shown in the drawings therein, the display uses a part of the cardboard or paper board to retain the article in a displayed position, and the package further containing appropriate apertures which would permit the racking of the article in a retail establishment. One of the drawbacks inherent im a package of this type is the fact that the package is not suitable for mailing since it is rather cumbersome, and has a rather large depth dimension in order to permit it to finction as a display package.

Another form of a windowed package as shown in U.S. Pat. No. 4,054,242, wherein the package is formed from a single blank, and includes a primary panel having a window located therein, and a secondary panel which in its assembled form, is positioned behind the primary panel. The window permits the consumer to observe some portion of the contents of whatever may be contained between the primary and secondary panel. Once again, it will be observed that any article which is secured within the package, would only be partially visible to the consumer since the window is located within one of the panels, and only permits a view of a portion of the interior contents of the package.

Still another form of a pocket envelope type package is shown in U.S. Pat. No. 4,204,600 wherein an easy opening envelope having a windowed portion positioned therein is described. Once again, the transparent window does not fully encase any article which would be packaged therein, but rather, the windowed portion of the package permits only a small view of the inner portion of the package such that should an article be contained therein, only a portion thereof would be visible.

It has been deemed desirable to create a package which may be used for mailing purposes, as well as display purposes, which at the same time, eliminates the high cost of blister packing, or other types of packages which require extensive and sophisticated molds to create.

OBJECTS AND ADVANTAGES

It is therefore the principal object of the present invention to provide a package formed from a paper board blank or other similar material, which includes a window formed in the blank, and having a fold line traversing the entire blank at the mid-position of the window formed therein, and having a transparent film overlying the window such that upon the folding of the panels along the fold line, an article contained within the transparent film is entirely encased within the film, and securely held in position between the blanks which are folded in face to face relationship.

In connection with the foregoing object, it is yet a further object to provide a package of the type described wherein the package assumes a very thin configuration thereby making the package suitable for mailing purposes, and wherein the blank may be further provided with an aperture such that the package may be racked in a retail establishment for display purposes.

It is yet a further object of the present invention to provide a package of the type described wherein the pouch formed from a transparent film is secured about all four of its side edges such that an article packaged therein is entirely secure within the package.

Further object of the invention is to provide a package of the type described above, wherein the panels, when brought into face to face relationship, are secured by means of a co-adhesive such that the transparent window contained therein is fully secured about all of its edges.

Still another object of the present invention is to provide a method of packaging an article consisting of the steps of forming a blank from paper board or other like stock, dividing the blank into panels by means of a fold line, forming a window in the blank, the window being symmetrically formed on each side of the fold line, applying an adhesive to the blank along the periphery of the window formed in the blank, covering the window by applying a transparent film material over the adhesive, applying a second coating of adhesive to the blank on the same side of the blank as the transparent film, forming the two panels into a v-shaped configuration with the fold line at the base of the "v" and the edges of the blank forming the ends of the "v", placing an article inside of the v-shaped configuration, and securing the two panels together around the article with the transparent material forming a display pouch for the article.

In conjunction with the foregoing object, it is yet a further object of the invention to provide a method of the type described wherein the panels may be brought into face to face relationship and compressively rolled together between compression rollers thereby to join the adhesive contained on each of the panels such that the two panels are secured one to the other.

Further features of the invention pertain to the particular arrangement of the elements and parts whereby the above-outlined an additional operating feature thereof are attained.

The invention, both as to its organization and method of operation, together with further objects and advantages thereof, will best be understood by reference to the following specification taken in connection with the accompanying drawings.

SUMMARY OF THE INVENTION

In summary, the present invention provides a package suitable for both mailing purposes, as well as display purposes, which permits an article to be packaged therein and fully enclose within a transparent pouch such that the entire article packaged therein is completely visible to the consumer. In addition, the package is created in a configuration such that the package is suitable for mailing purposes through the U.S. Postal System, while on the other hand, the blank forming the package is appropriately apertured in order to permit the package to be racked on a display rack for display purposes.

The present invention relates to a package which can be used for both mailing and display purposes and also encompasses the method of manufacturing the same. A pre-molded blister pack is not required nor is sophisticated cutting, folding or bending of the cardboard or paper board blank required as is the case in other prior packages. Furthermore, a sealed pouch results from applicant's design such that the contents to be mailed or displayed are protected from moist environmental conditions and also the contents are retained with a minimum likelihood of leakage or spilling. Applicant's package can be used as both a mailing package or as a display package at the point of sale. With the proper adhesive, the inventive package could be shipped in the unsealed state to the point of sale user who can insert the contents which are to be displayed and seal the package himself.

According to the specific embodiment illustrated in the drawings of this application and discussed in detail below, the display and mailing package is prepared from a one piece cut and squared paper board blank. A single fold line divides the blank into two panels, a front panel and a rear panel. A window is cut into the blank and is symmetrical on each side of the fold line, each half of the window being in one of the two panels. The window is completely enclosed by the blank. A piece if transparent film is fastened on all sides of the window to the blank and covers the window. This transparent film material subsequently forms the pouch which will enclose the article to be displayed. The front and rear panels are folded together about the fold line and adhesively attached in face to face contact. Thus, the pouch encloses the article. Mounting holes can be puched in the package for hanging on display racks.

The method of packaging the article comprises forming a blank from a paper board roll stock, the blank generally being rectangular in shape. The blank is then scored to form a fold line and a window is punched out of the blank symmetrical with the fold line. An adhesive is applied around the window and a transparent film material is attached covering the window by means of the adhesive. A second coating of adhesive is applied to the blank around the window and adjacent blank areas. The blank is then folded into an open v-shaped configuration with the fold line at the base of the "v". The article to be displayed is dropped into the base of the "v" where the transparent film has formed an open pouch. The two insides of the "v" are then secured together by means of the previously applied adhesive and the display pouch is sealed about the article.

Accordingly, it may be seen that the display package of the present invention provides an economical and simple pouch-type package that can be used as both a mailer and point of sale display package. It can be printed on either or both sides. It also does not require the use of any pre-molded blister type package and one size package can accommodate numerous items. Another object of the invention is to provide a combination display and mailing package which completely encloses the article to be displayed such that the article is securely retained in the package for mailing and cannot be easily removed from the package which protects the packaged articles from moist environments yet still be retained in a see-through pouch for display purposes. It is a further object to provide a method of manufacturing a display package of the above type which is adaptable for packaging may types of articles manually, semi-automatically, or by means of fully automatic machinery.

DETAILED DESCRIPTION OF THE DRAWINGS

Figure 6B:
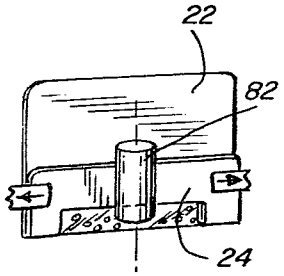
Figure 6A:
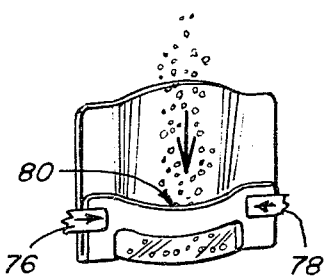

FIGS. 6*a* and 6*b* are schematic illustrations of an alternative method used to fill and seal the display package.

DESCRIPTION OF THE PREFERRED EMBODIMENT

Figure 1:
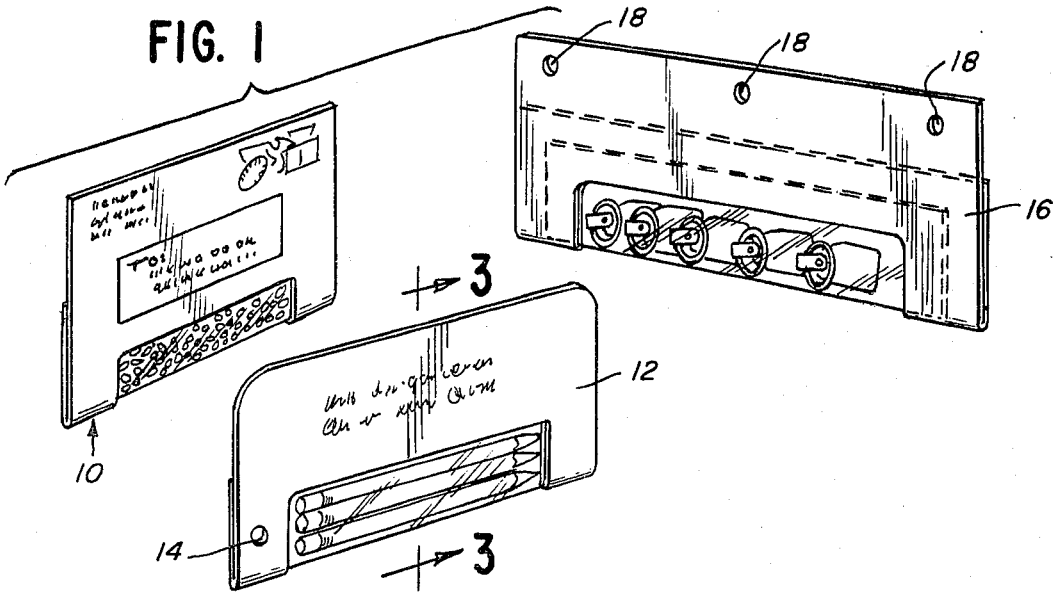
FIG. 1 is a perspective view of three various mailing and display packages in accordance with the invention.

Reference is first made to FIG. 1 of the drawings which illustrates three mailing or display packages in accordance with the invention. First there is illustrated a mailing package or mailer 10 which functions as a display package for the article and also an envelope to transmit it through the mail. There is room on the front of the mailer 10 for the destination address, the return address and the postage. The rear of the mailer 10 could have advertising literature or other information printed. In a second embodiment there is illustrated a vertical display package 12 which is similar to the mailer 10 except there is added a mounting hole 14 from which the display package 12 can be hung on a pegboard or other similar display racks. A third embodiment is illustrated as a horizontal display package 16 which is similar to the vertical display package 12 with the exception of mounting holes 18 being placed in such a manner that the display package 16 will hang with its longest dimension horizontally instead of vertically.

Figure 2:
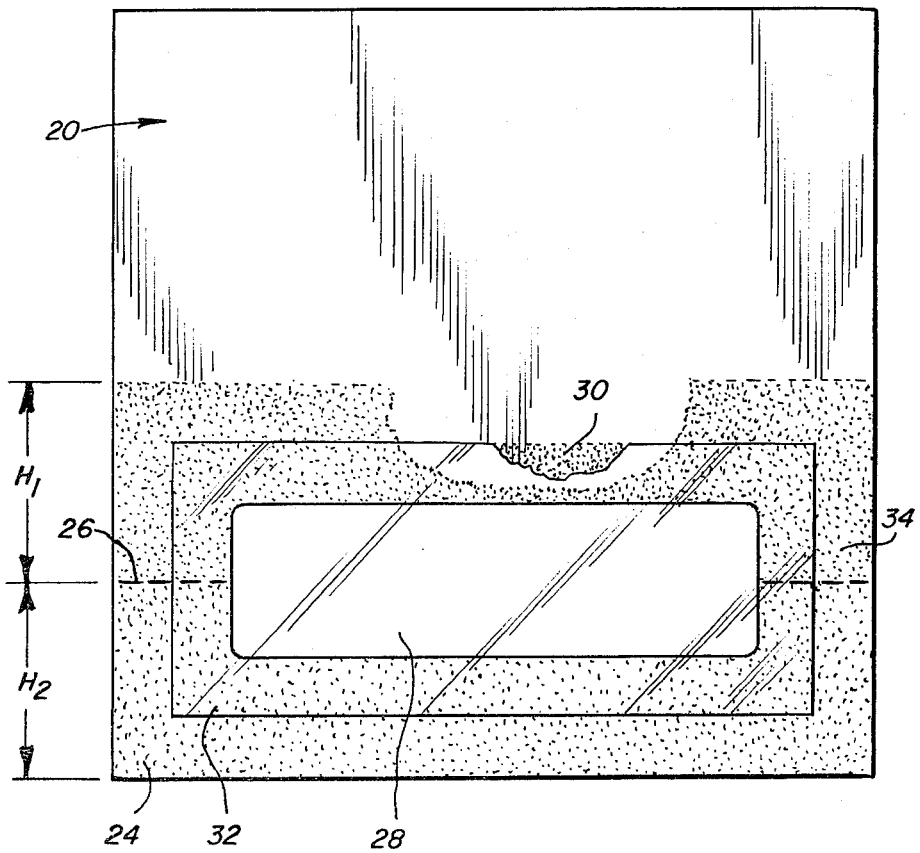
FIG. 2 is a top plan view of the blank with portions of the adhesive and transparent film removed to expose the various layers.

The package illustrated in FIG. 1 were all made from a cardboard balnk 20 such as illustrated in FIG. 2. The blank 20 is made of stiff paper, cardboard, paper board or similar material. It is divided into a front panel 22 and rear panel 24 by means of a scored fold line 26. The size of the front and rear panels relative to each other are determined by the position of the fold line 26. Symmetrical with the fold line 26 is a generally rectangular window 28 cut from the cardboard blank 20. It is important that the window 28 be formed symmetrically in each of the front and rear panels, 22 and 24, are folded together the window 28 will properly form a receiving pouch. Other shapes than the illustrated rectangular configuration could be utilized, but they must be symmetrical mirror images on each side of the fold line 26. This is necessary so that the transparent film pouch will be identical when viewed from either the front or rear.

The cardboard blank 20 completely borders the window 28 on all sides. A first adhesive 30 is applied around the perimeter of the window 28 on the blank 20. A transparent film material 32 such as high strength polyethylene or polypropylene is then applied to the first adhesive 30. It is important that the adhesive 30 be placed on the blank 20 continuously around the perimeter of the window 28 without any gaps or openings such that the film 32 is secured around its entire perimeter to the blank 20. The film 32 should be slightly larger than the window 28 yet still leave a border area between the film and the outside edges of the blank 20.

A second adhesive 34 is then applied to completely surround the window 28. Generally, the second adhesive 34 should be applied from the window 28 to the lowermost edge of the rear panel 24. The height of the application of the second adhesive should be from the fold line 26 to a height H-1 which is substantially equal to a height H-2 which is the distance from the fold line to the lowermost edge as indicated in FIG. 2. In the preferred embodiment the second adhesive is the type of adhesive which after drying does not readily adhere to objects which are of different chemical formulation than itself. However, these adhesives adhere very strongly when in contact with another object having the same adhesive applied to it and allowed to dry.

Figure 3:
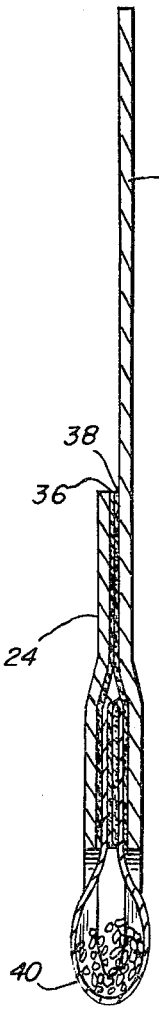
FIG. 3 is an enlarged cross-sectional view taken along line 2—2 of FIG. 3 showing the layers of the finished package.

The article to be displayed is then dropped into the window area 28 and the rear panel 24 is folded along fold line 26 and pressed into contact with the front panel 22. The adhesive 34 adheres to itself very strongly as the two panels 22 and 24 come into face to face contact. This can more easily be seen in FIG. 3 wherein adhesive layers 36 and 38 adhere to each other. As the rear panel 24 is now firmly affixed to the front panel 22 a pouch 40 which contains the article to be displayed is formed. One of the four edges of the pouch is formed at the time of folding the panels together and is contingent with the fold line. If both the first adhesive 30 and the second adhesive 34 were applied continuously around the perimeter of the window 28 a double sealed pouch 40 is formed. The firt seal is that formed by the transparent film material 32 affixed to itself and the second by the front and rear panels 22 and 24 being glued together.

An alternative adhesive to the co-adhesive 34 would be a heat sealed type of adhesive which causes the two panels to seal after heating a previously applied heat sensitive adhesive. The resultant product is similar, the only difference being the method of manufacture.

Figure 4:
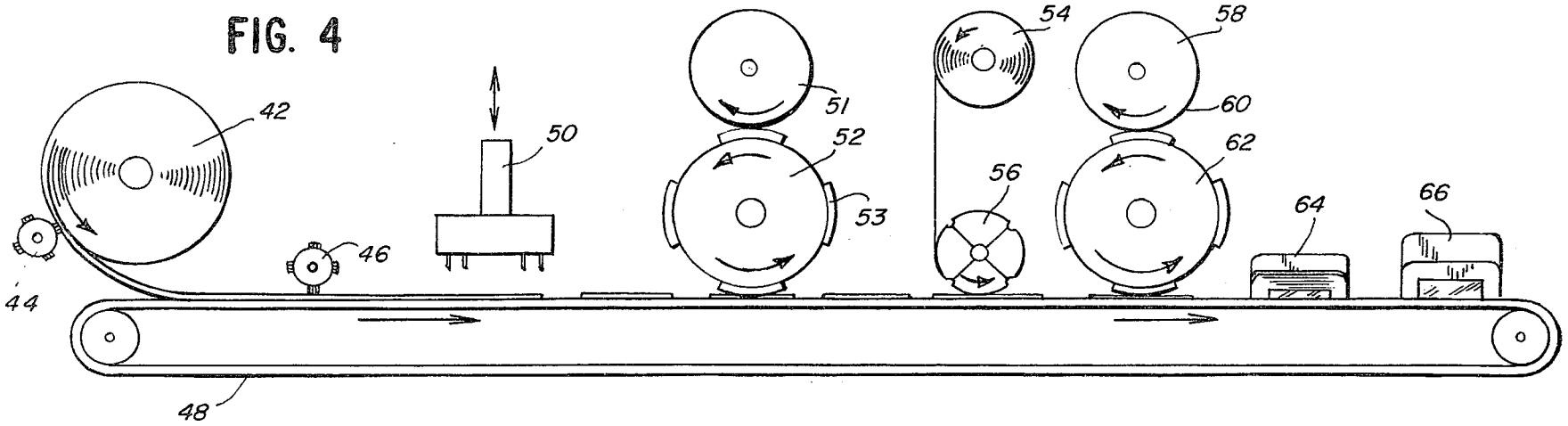
FIG. 4 is a schematic illustration of an assembly line which illustrates the method and various stations used in manufacturing the completed display package.

The method of manufacturing the combination mailing and display package is illustrated schematically in FIG. 4. First a paper or cardboard roll stock 42 dispenses the backing material from which the blank 20 is made. The front and back of the roll stock 42 can be respectively printed at printing stations 44 and 46. A conveyor 48 moves the roll stock 42 to a cutting station 50 where the roll stock is cut into blanks into blanks 10, and squared and scored to form a fold line. An adhesive supply wheel 51 supplies adhesive to an applicator 52 having extended segments 53 which are positioned to apply the adhesive to the proper portion of blank 20 as it passes beneath the applicator 52. The adhesive supplied at this point is that used to fasten the transparent film 32 to the blank 20 to cover the window 28.

At the next station, a transparent material supply roll 54 feeds the transparent film material 32 to a cutter and applicator 56 which secures the transparent film 32 to the blank 20. The second adhesive or co-adhesive is next applied at station 58. An adhesive supply wheel 60 supplies the adhesive to an applicator 62 which in turn applies it at the proper time and location to the blank 20.

At the article receiving station 64 the blank 20 is folded upward along the fold line 26 to form a "v" configuration with the base of the "v" being at the fold line 26. The article to be displayed or mailed is then deposited into the window area 28 which has the transparent film 32 and the package 10 is then completely sealed at sealing station 66.

Figure 5:
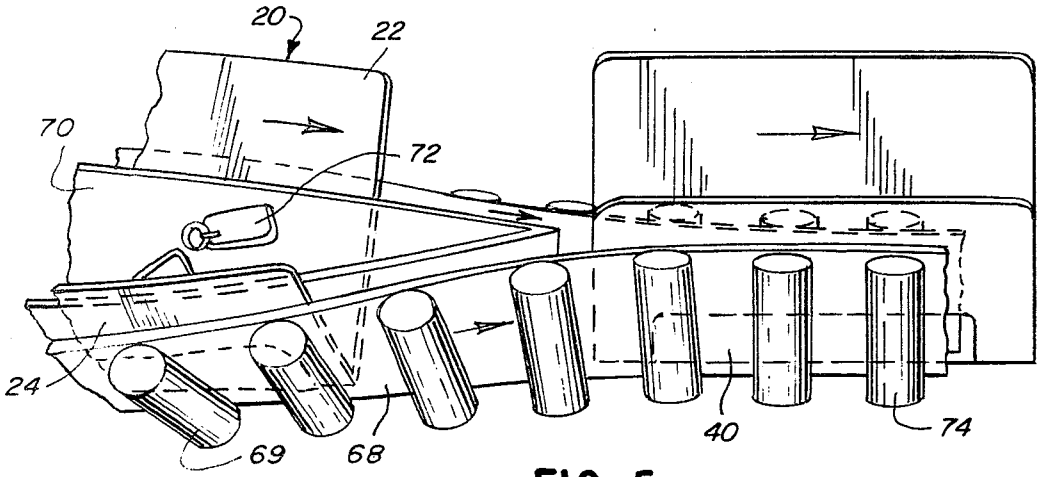
FIG. 5 is an enlarged view with portions removed of one type of filling and sealing station.

FIG. 5 illustrates in more detail the method of receiving the article to be displayed and a method of sealing the package. The conveyor belt 68 by means of conveyor drive rollers moves the cardboard blank 20 in the direction indicated by the arrows. The blank 20 is captured between guide rails 70 and feed conveyor belt 68. As the blank 20 is formed into a v-shaped configuration, article 72 is manually or automatically dropped into the v-folded blank. The blank 20 with the article 72 in its proper position, is moved past the guide rails 70 and is then pinched between sealing rollers 74. The sealing rollers are positioned and dimensioned so that they cannot crush the article 72 which is retained in the pouch 40. This type of sealing arrangement is best utilized with co-adhesive where merely the pressure of the rollers is sufficient to adequately seal the front and rear panels, 22 and 24, to each other. The addition of heat would be required if a heat sealing adhesive was utilized. The heat can be applied by external means or by heating the sealing rollers 74.

An alternative method of filling the package is illustrated in FIGS. 6*a* and 6*b*. Instead of using a conveyor belt 68 and guide rails 70 as illustrated in FIG. 5, the package is held at its edges by means of pinching fingers 76 and 78. The compressive force of pinching fingers 76 and 78 will cause the coadhesive to adhere to itself around the edges of the package thus giving an adequate seal at these edges. The fingers are then caused to compress the package in the direction of the arrows of FIG. 6*a* causing the front panel 22 and rear panel 24 to bow outwardly as illustrated at 80. This forms a receiving pouch area through which the article to be displayed can be deposited. The pinching fingers 76 and 78 are then moved outwardly in the direction of the arrows of FIG. 6*b* while still compressively retaining the front and rear panels 22 and 24 therebetween. A sealing roller 82 completes the sealing process by forcing the front and rear panels 22 and 24 together so that the adhesive layers are joined.

The various stations illustrated in FIGS. 4–6 can be performed by those skilled in the art of packaging with packaging equipment commercially available or easily modified to perform the steps indicated.

Thus it is apparent that there has been provided, in accordance with the invention, a package and method of making the same that fully satisfies the objects, aims, and advantages set forth above. While the invention has been described in conjunction with specific embodiments thereof, it is evident that many alternatives, modifications and variations will be apparent to those skilled in the art in light of the foregoing description. Accordingly it is intended to embrace all such alternatives, modifications, and variations as fall within the spirit and broad scope of the appended claims.

I claim:

1. The method of packaging an article comprising:
forming a blank from paper board or the like stock,
dividing the blank into panels by means of a fold line,
forming a window in the blank, the window being symmetrically formed on each side of the fold line,
applying an adhesive to the blank around the window,
covering the window by applying a transparent film material to the adhesive,
applying a second coating of adhesive to the blank on the same side of the blank as the transparent film was applied to,
forming the two panels into a v-shaped configuration with the fold line at the base of the "v" and edges of the blank forming the ends of the "v",
placing the article inside the v-shaped configuration,
securing the two panels together around the article with the transparent material forming a display pouch for the article.

2. The method of claim 1 wherein the method of securing the two panels together comprises comproses compressively rolling the two panels between two rollers thereby joining the adhesives on each panel to each other.

3. The method of claim 1 and pinching the two panels together to close the v-shaped configuration, applying a compressive force at the edges of the blank to cause said panels to bow out relative to each other, placing the article within the bowed out panels, releasing the compressive force and compressing the two panels together.

* * * * *